US006619518B1

(12) United States Patent
Lee

(10) Patent No.: US 6,619,518 B1
(45) Date of Patent: Sep. 16, 2003

(54) SPOUT ASSEMBLY FOR LIQUID CONTAINER

(76) Inventor: Jung Min Lee, #705, Hosan Plaza Apt. 37, Samsung-dong, Kangnam-gu, Seoul 135-092 (KR)

( * ) Notice: Subject to any disclaimer, the term of this patent is extended or adjusted under 35 U.S.C. 154(b) by 0 days.

(21) Appl. No.: 10/031,656

(22) PCT Filed: Mar. 12, 2000

(86) PCT No.: PCT/KR01/00384

§ 371 (c)(1),
(2), (4) Date: Nov. 13, 2001

(87) PCT Pub. No.: WO01/74682

PCT Pub. Date: Oct. 11, 2001

(30) Foreign Application Priority Data

Mar. 12, 2000 (KR) ..... 2000-12929

(51) Int. Cl.[7] ..... B67D 3/00; B67D 5/06

(52) U.S. Cl. ..... 222/529; 222/530; 222/535

(58) Field of Search ..... 222/481.5, 527, 222/528, 529, 530, 535, 569, 570; 220/707, 708, 709

(56) References Cited

U.S. PATENT DOCUMENTS

| | | | | | |
|---|---|---|---|---|---|
| 3,357,429 | A | * | 12/1967 | Folkman et al. | 604/324 |
| 4,080,989 | A | * | 3/1978 | Chapelsky et al. | 137/588 |
| 4,428,498 | A | * | 1/1984 | Obey | 220/367.1 |
| 4,461,406 | A | * | 7/1984 | Vannucci | 222/211 |
| 4,586,625 | A | | 5/1986 | Garrett | 220/266 |
| 4,618,078 | A | * | 10/1986 | Hamman et al. | 222/478 |
| 4,928,861 | A | * | 5/1990 | Schiemann | 222/481.5 |
| 5,071,019 | A | | 12/1991 | Sizemore | 220/709 |
| 5,361,934 | A | | 11/1994 | Spence | 220/707 |
| 5,361,935 | A | * | 11/1994 | Sagucio | 220/709 |
| 5,897,013 | A | * | 4/1999 | Manganiello | 220/252 |
| 6,293,394 | B1 | * | 9/2001 | Marbler et al. | 206/218 |

FOREIGN PATENT DOCUMENTS

JP 2000289763 10/2000

* cited by examiner

*Primary Examiner*—Joseph A. Kaufman
(74) *Attorney, Agent, or Firm*—Norris McLaughlin & Marcus

(57) ABSTRACT

A spout assembly for a liquid container comprises a body 100 coupled with a neck of a container 400 including an opening portion N which is protruded from a top side of the body 100, a spout 200 movably inserted into the opening portion N for drinking of liquid contained in the container or dispensing the liquid into another container, and a cap 300 coupled around the opening portion N to open and close the spout 200, wherein the opening portion N of the body 100 has a bendable thin plate portion and the spout 200 has a bendable portion, thereby the opening portion N of the body can be bent in a direction.

25 Claims, 15 Drawing Sheets

SPOUT ASSEMBLY FOR LIQUID CONTAINER

TECHNICAL FIELD

The present invention relates to a spout assembly for a liquid container that is designed to enable easy and convenient drinking of liquid contained in the container through an associated spout, easily dispense the liquid into another container, and have a bendable opening portion (being coupled with a cap) which is associated with the spout and can be bent so that the containers to which the spout assemblies are applied can be stacked in a multi-layer configuration.

BACKGROUND ART

Korean utility model registration No. 173,350 to the applicant of this invention discloses a prior art of the invention.

The prior art discloses a spout assembly for a liquid container. The spout assembly is designed to have an associated straw so as to enable drink liquid beverages contained in the container through the straw, while enabling dispensing the liquid beverages contained in the container into another container. However, this utility model does not disclose a spout assembly of the present invention that has a spout associated with the straw can be bent in a direction.

That is, the spout of the prior spout assembly is vertically projected out of a top surface of the container. This makes it impossible to stack the liquid container in a multi-layer configuration, thereby causing the disadvantage of distribution. Therefore, the present invention has been made in an effort to solve the problem. It is an objective of the present invention to provide a spout assembly that is provided with a bendable thin plate so that a spout (being coupled with a cap) can be bent in a direction.

DISCLOSURE OF INVENTION

Therefore, the present invention has been made in an effort to solve the problem. It is an objective of the present invention to provide a spout assembly that is provided with a bendable thin plate so that a spout (being coupled with a cap) can be bent in a direction.

To achieve the above objective, the present invention provides a spout assembly for a liquid container comprising a body that can be coupled with the liquid container and an opening portion (being coupled with a cap) associated with a spout which is provided at a top side of the body, wherein the opening portion is provided with a bendable thin plate so that the opening portion can be bent in a direction.

The body of the present invention can be bonded with the container, and the bonding portion of the body can easily transfigure in accordance with the shape of the container.

BRIEF DESCRIPTION OF DRAWINGS

Other objects and aspects of the invention will become apparent from the following description of embodiments with reference to the accompanying drawings in which.

BEST MODE FOR CARRYING OUT THE INVENTION

Figure 1A:
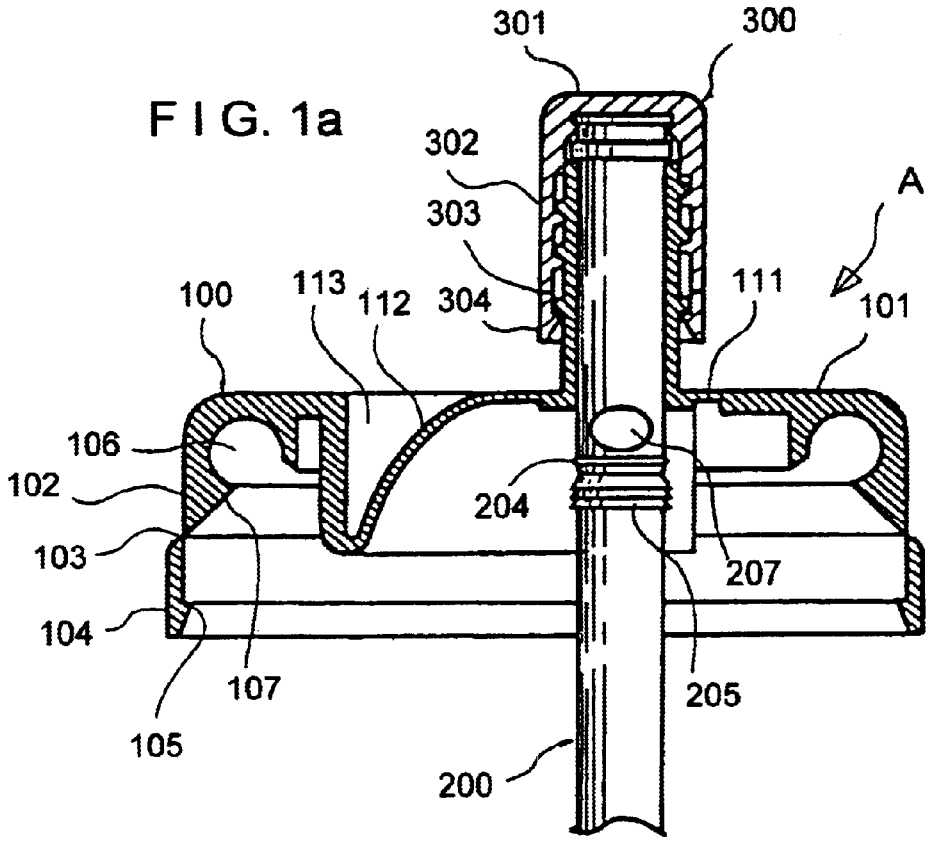
FIG. 1*a* is a sectional view of a spout assembly according to a first embodiment of the present invention.
Figure 1B:
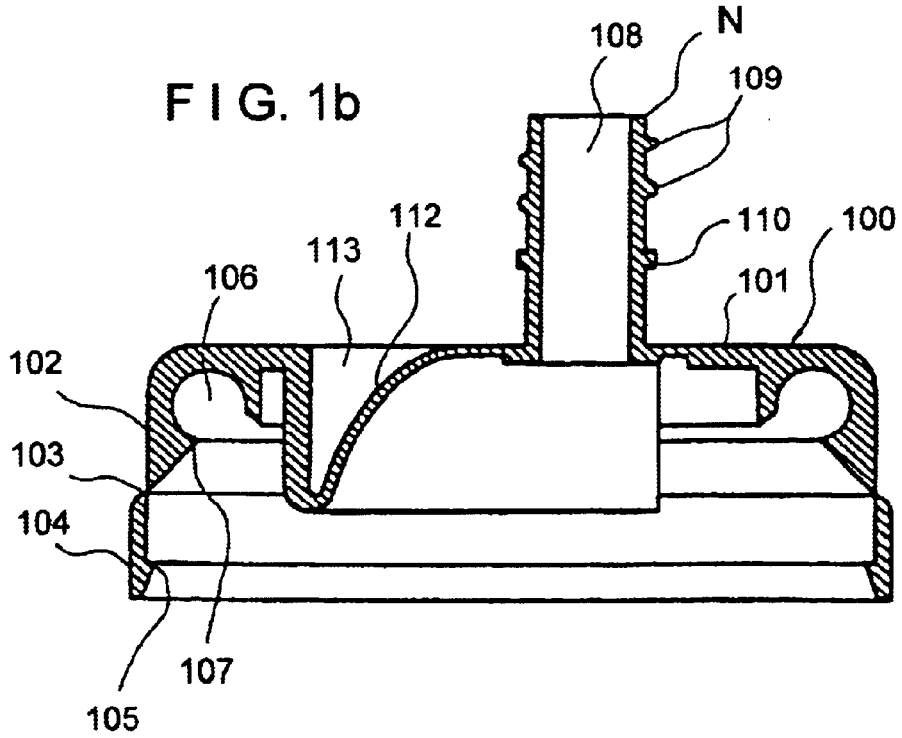
FIG. 1*b* is a section view of a main body of a spout assembly according to a first embodiment of the present invention.
Figure 1C:
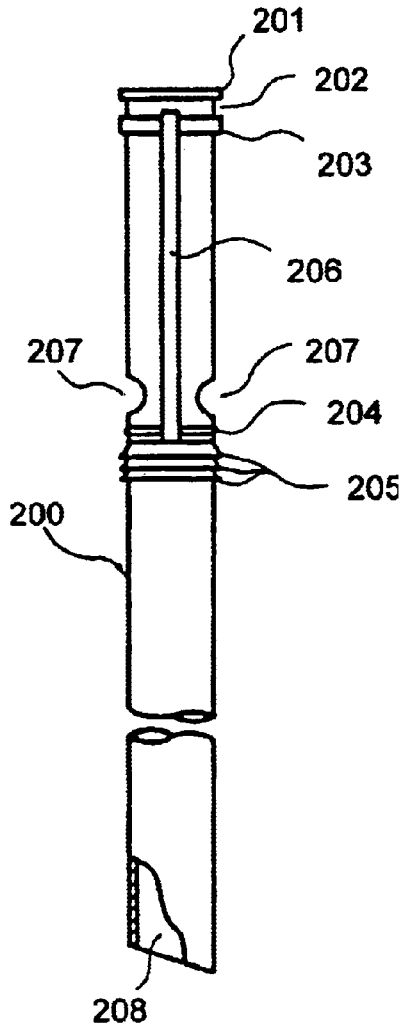
FIG. 1*c* is a sectional view of a spout.
Figure 1D:
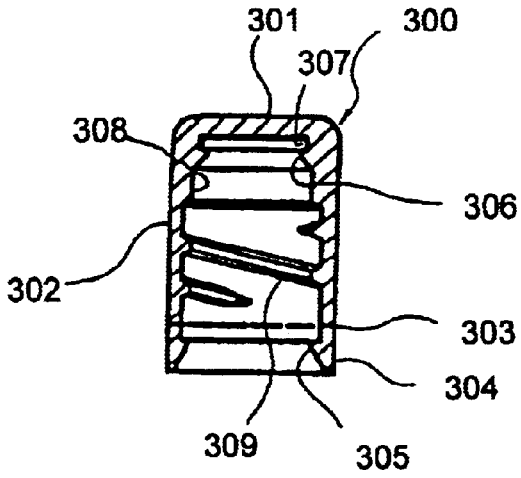
FIG. 1*d* is a sectional view of a cap.

Reference will now be made in detail to the preferred embodiments of the present invention.

A spout assembly for a liquid container comprises a body 100 coupled with a neck of a container 400 including an opening portion N which is protruded from a top side of the body 100, a spout 200 movably inserted into said opening portion N for drinking of liquid contained in the container or dispensing the liquid into another container, and a cap 300 coupled around the opening portion N to open and close the spout 200. The opening portion N of the body 100 has a bendable thin plate portion and the spout 200 has a bendable portion, whereby the opening portion N of the body can be bent in a direction.

The body is provided with an upper surface portion 101, a side wall portion 102 and an opening identification skirt 104 having an engagement jaw 105, divided by a separating guide line 103 at the bottom of the side wall portion 102. An inner surface of the side wall portion 102 is provided with an engagement jaw 107 having an inserting groove 106. The upper surface portion 101 is provided with the opening portion N having an spout inserting hole 108 upwardly protruded therefrom. An outer annular portion of the opening portion N is provided with a thread 109 and a bottom protruding annular portion 110. A parabola shaped bendable thin plate portion 112 is provided at the opposite portion of a connecting thin plate 111 in the bottom of the opening portion N and on the upper portion 101. A space 113 having a guiding portion 114 is provided at the outside of the bendable thin plate 112.

The spout 200 is provided at its upper end with an annular protrusion 201, an annular groove 202 and an annular band 203, and at its bottom end with an annular band 204 and a bendable thin plate 205. The spout 200 is further provided with an air inflow groove 206 longitudinally between annular bands 203 and 204, at least one side outflow hole 207 at each side of the air inflow groove 206, and the side outflow hole 207 communicated with a liquid passage 208.

The cap 300 comprises the upper surface portion 301, the side wall portion 302, and an opening identification skirt 304 having the engagement jaw 305 divided by the separating guide line 303 at the bottom of the side wall portion 302, the inner wall of the side wall portion being provided with an engaging protrusion 306 having an annular engagement groove 307, the bottom inner wall of the engagement protrusion 306 being formed with a sealing wall 308 for maintaining the sealing contacting the outer circumference surface of the upper end of the opening portion N of the body 100, and downwardly therewith, and a thread 309 for engaging the thread 109 of the opening portion N being provided.

Figure 1E:
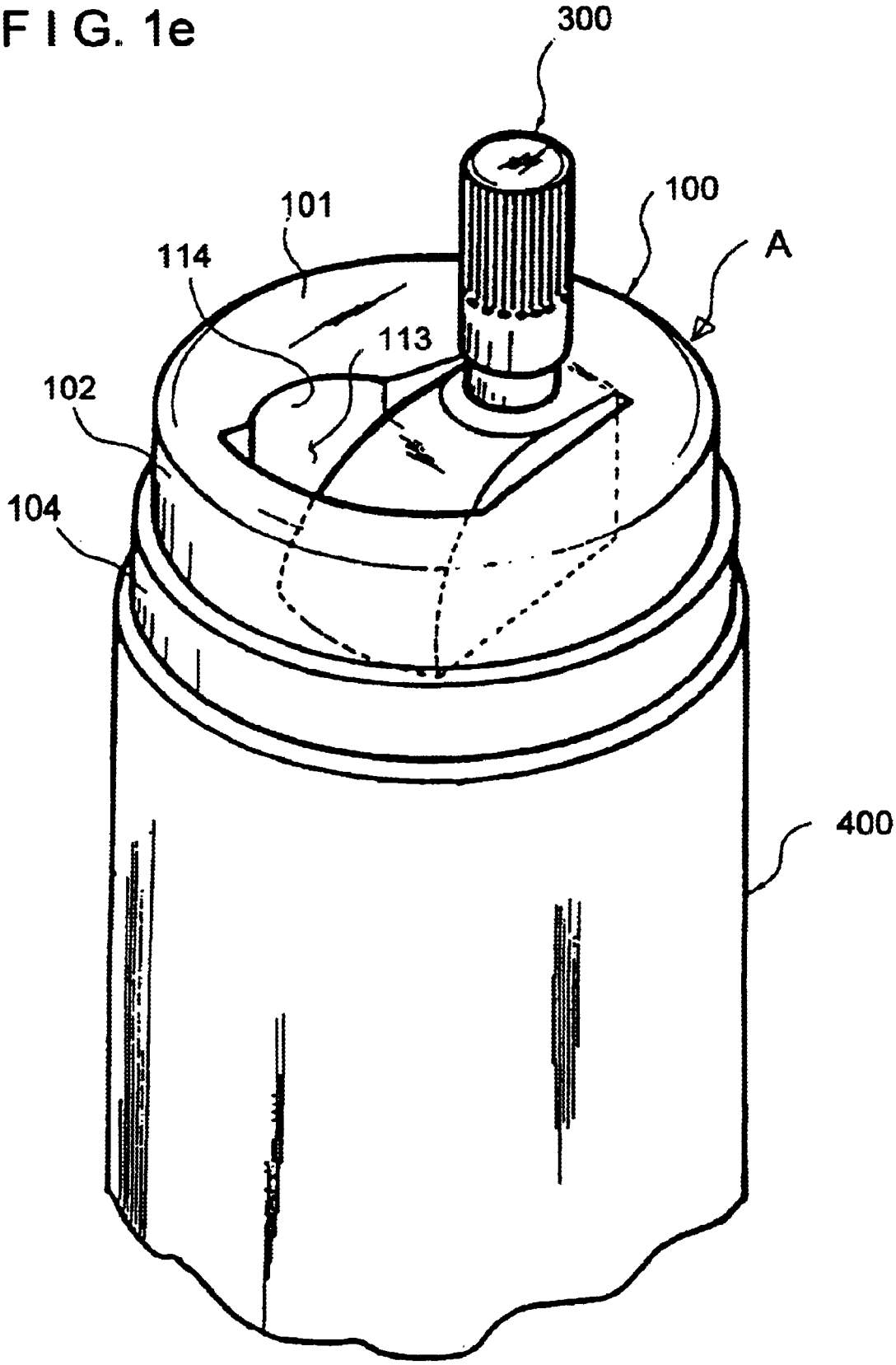
FIG. 1*e* is a perspective view of a container where a spout assembly is employed.
Figure 1F:
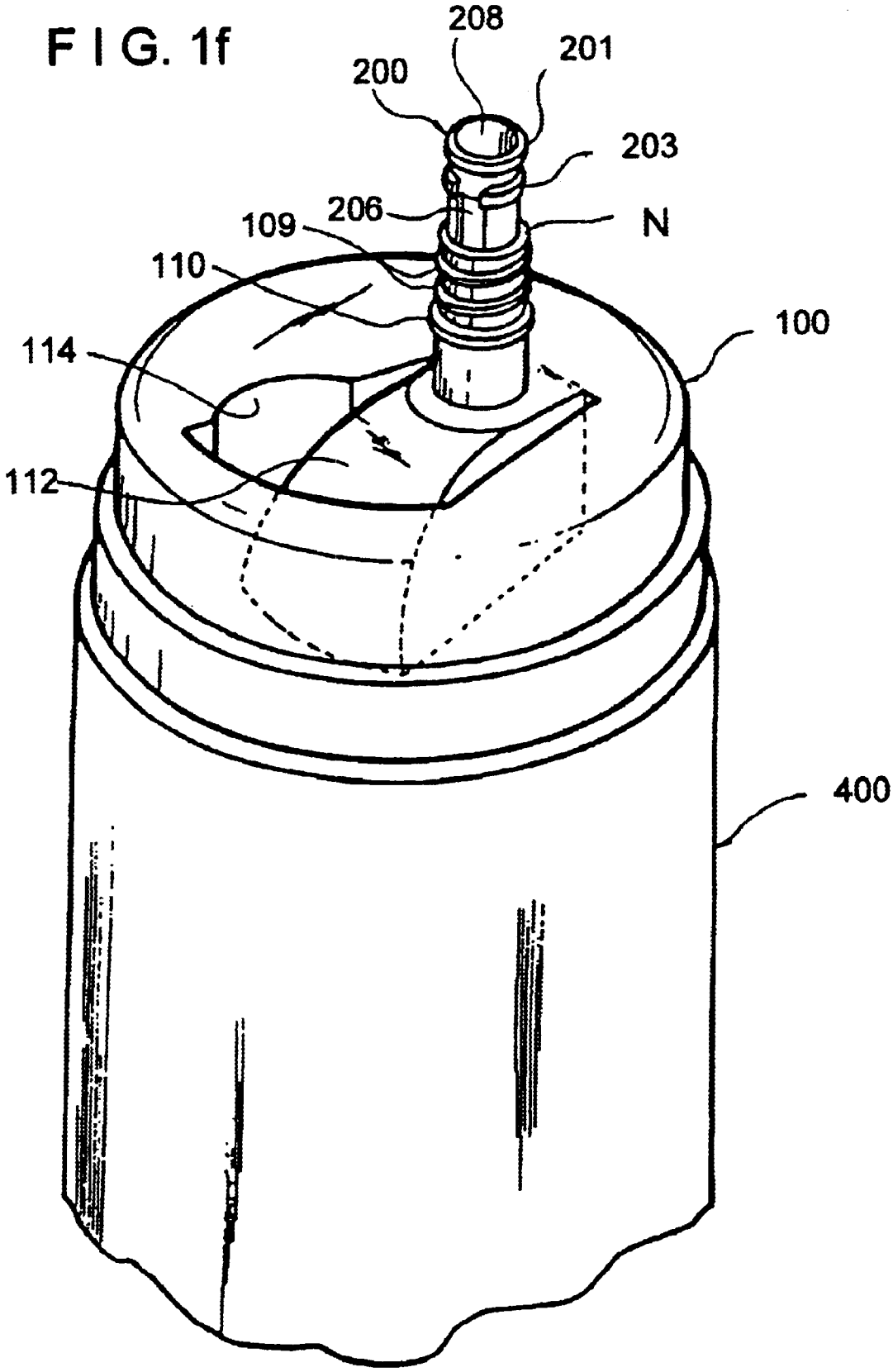
FIG. 1*f* is a perspective view of a container, in which is cap is opened.
Figure 1G:
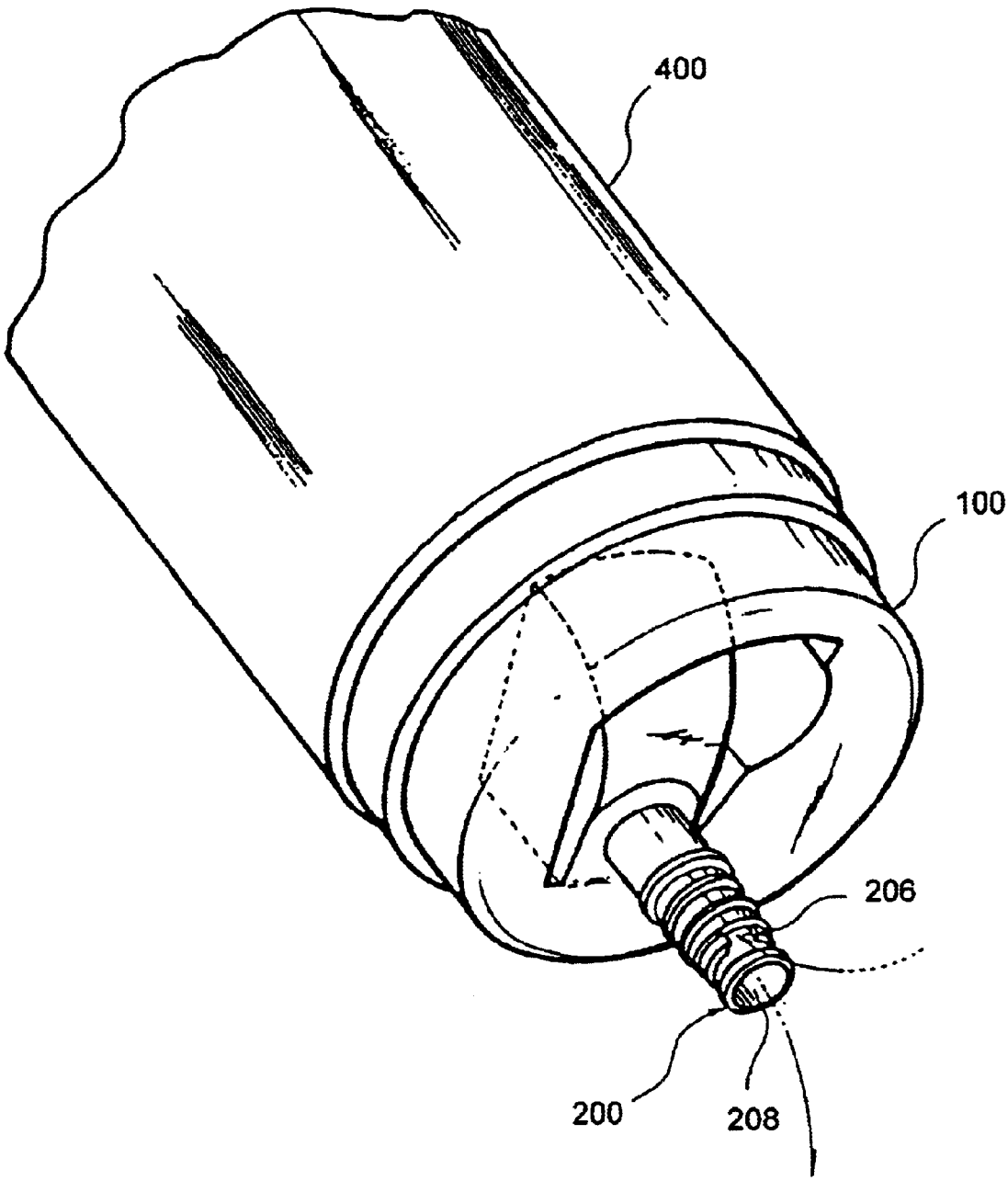
FIG. 1*g* is a perspective view of a container, showing a dispensing state.

FIG. 1*e* shows a spout assembly A assembled to a neck of a container 400. When the cap 300 is rotated in an opening direction, the opening portion N of the spout 200 moves upwardly as shown in FIG. 1*f*. When pushing the spout 200, the spout 200 moves downwardly and it is easy to dispense the liquid of the container 400 to another container.

Figure 1H:
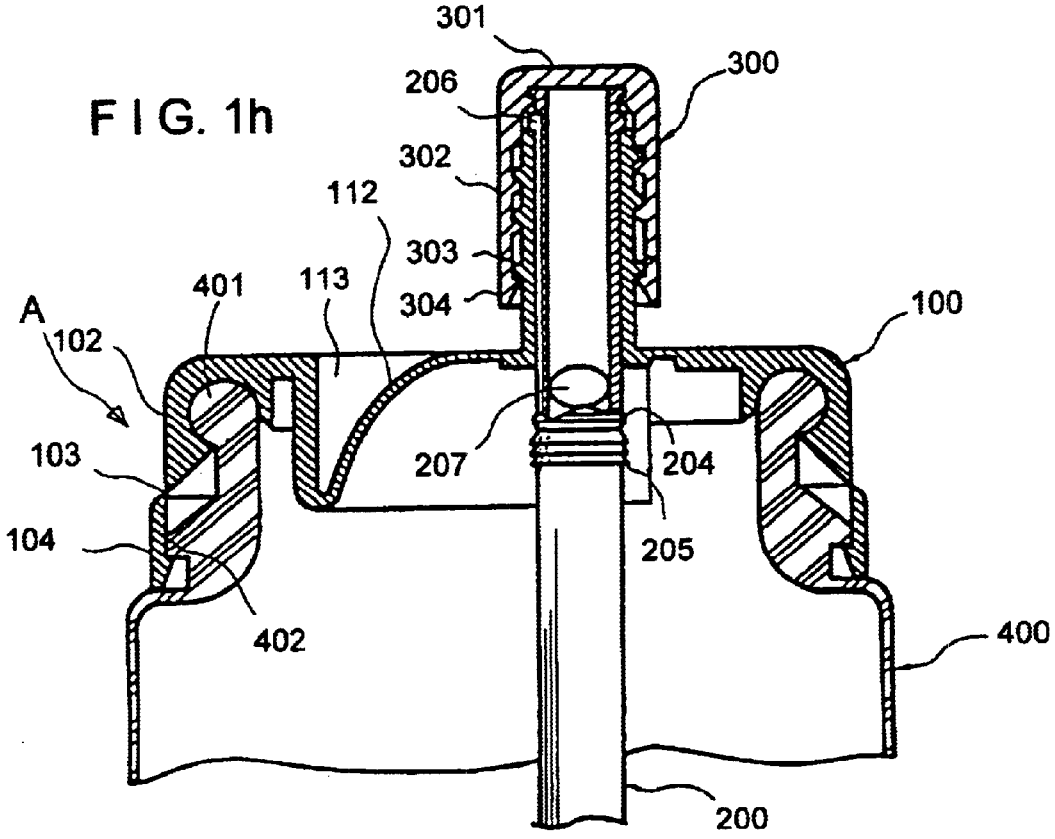
FIG. 1*h* is a sectional view of an assembled state of a spout assembly to a neck of a container.

FIG. 1*h* shows the spout assembly A mounted on the neck of the container 400. After the spout assembly A of the invention is mounted on the neck of the container, the opening portion N is bent in a direction as shown in FIG. 1*l*. At this point, the bendable thin plate portion 112 spreads downwardly opposite to the connecting thin plate 111. In certain circumstances, the spout assembly A can be assembled to the neck of the container as the opening portion N is bent in a direction.

In the state of FIG. 1*h*, when the cap 300 is rotated in an opening direction, the thread 309 of the cap 300 upwardly moves along the thread 109 of the opening portion N and consequently the spout 200 upwardly moves because the annular protrusion 201 of the spout 200 is rigidly inserted into the annular engaging protrusion 306 of the cap 300.

Figure 1I:
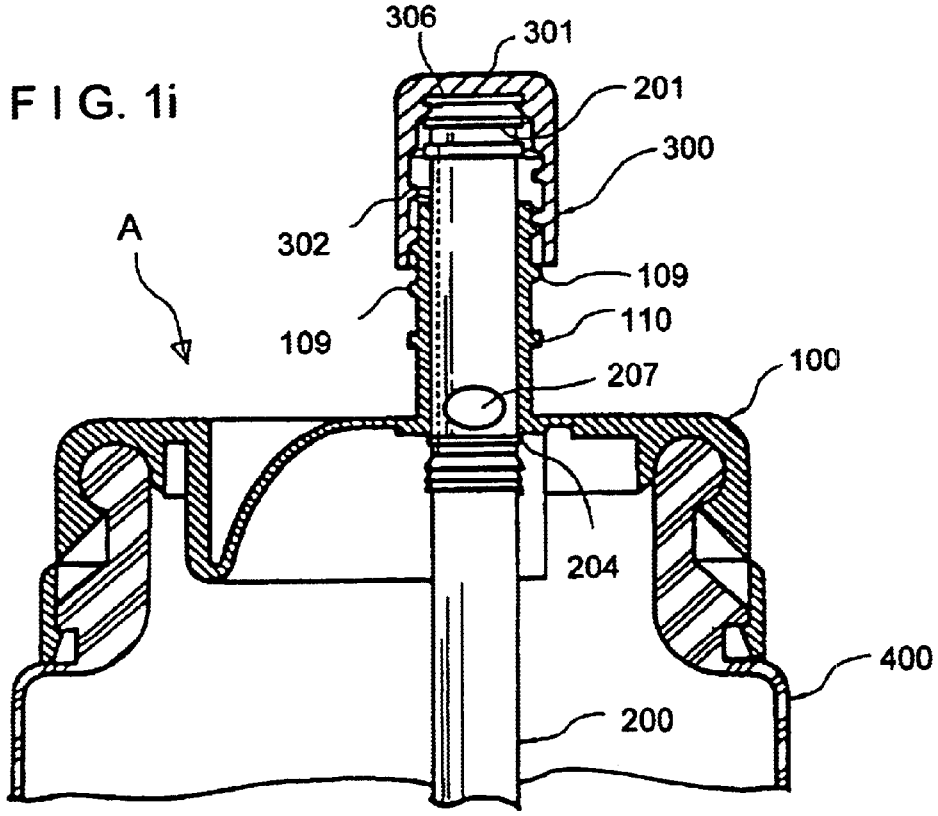
FIG. 1*i* is a sectional view of a spout assembly, in which a cap is being opened.

Referring to FIG. 1*i*, when the cap 300 is further rotated in an opening direction, the annular band 204 of the spout 200 contacts the bottom of the opening portion N thereby the spout 200 stops moving. In this state, when the cap 300 is further rotated in the opening direction, the annular protrusion 201 of the spout 200 is flexibly separated from the annular engaging protrusion 306 of the cap 300.

In the state of FIG. 1*i*, the cap 300 can be easily separated from the opening portion N. The opening identification skirt 304 formed below the cap 300 is removed as the separating guide line is broken. The opening identification skirt 304 may be separated or not from the side wall portion 302.

Figure 1J:
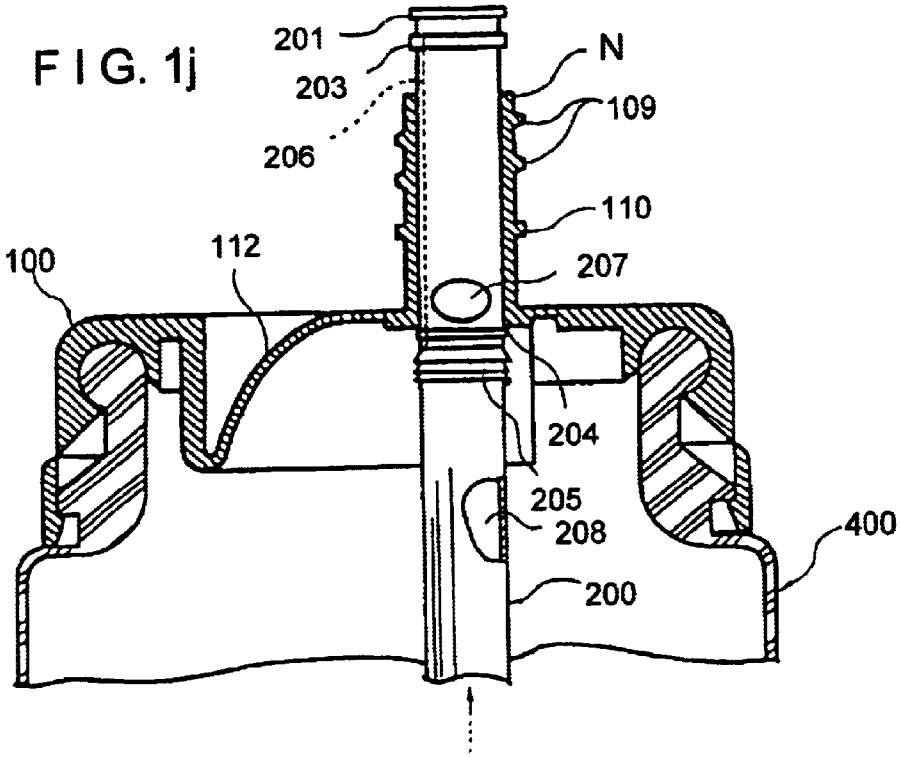
FIG. 1*j* is a sectional view of a spout assembly, in which a cap is opened.

Referring to FIG. 1*j*, the liquid of the container 400 can be sucked through the liquid passage 208 of the spout 200. Consequently, as the air inflows into the container 400 through the air inflow groove 206, the container 400 does not shrink and it is easy to dispense the liquid of the container 400. As the spout 200 upwardly moves and the outflow hole 207 of the spout 200 is sealed with the inner wall of the spout inserting hole 108 of the body 100, the liquid of the container 400 can easily dispense through the outflow hole 208.

Referring to FIG. 1*j*, when the spout 200 is pushed, the spout moves to the initial position and the outflow hole 207 of the spout 200 moves out of the spout inserting hole 108 of the opening portion N of the body 100 to communicate with the inner space of the container.

Figure 1K:
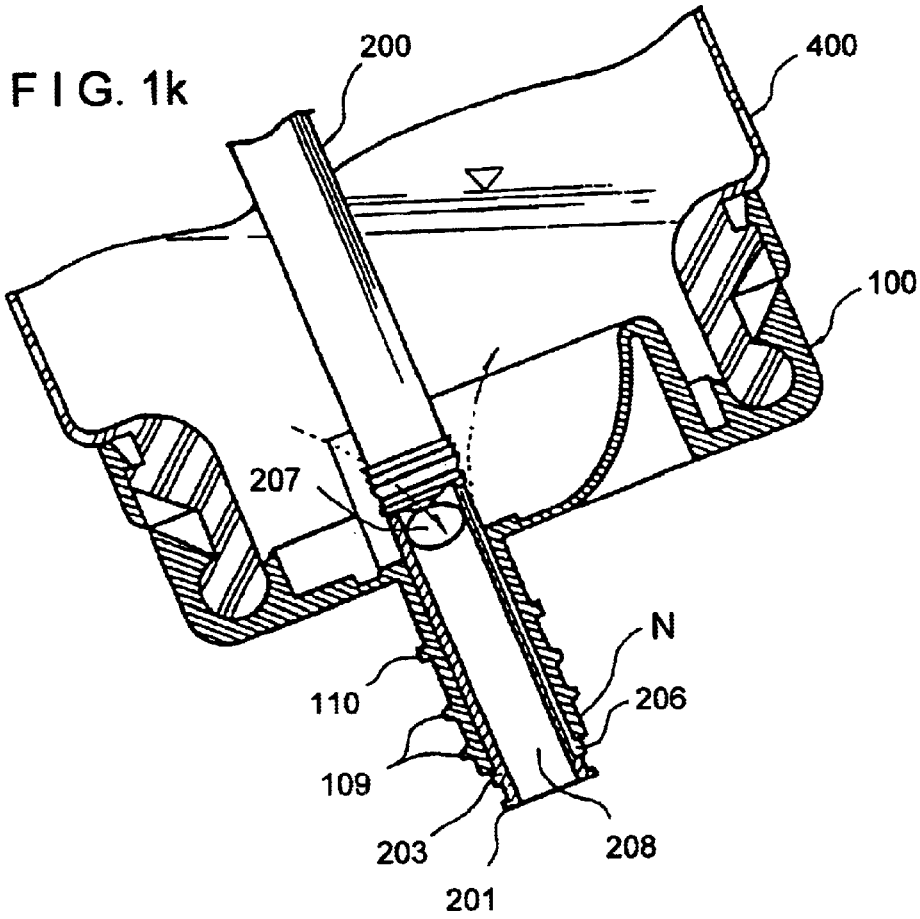
FIG. 1*k* is a sectional view of a spout assembly, showing a dispense state of liquid to another container.
Figure 1L:
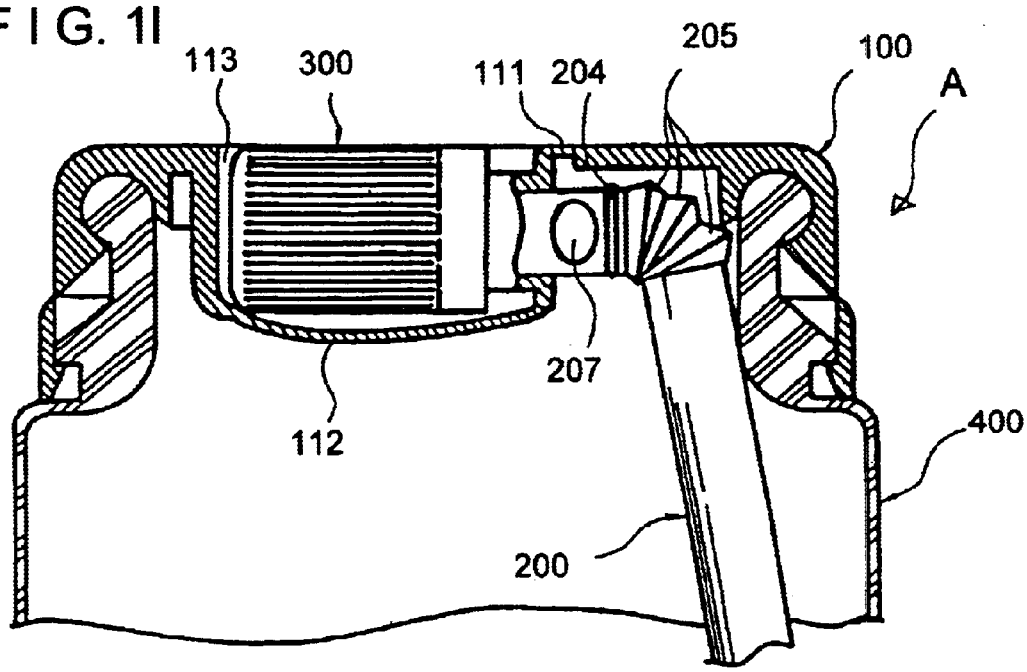
FIG. 1*l* is a sectional view of a spout assembly assembled on a bottle neck, in which an opening is bent in a direction.

Referring to FIG. 1*k*, when the container is tilted in a direction, the liquid of the container 400 flows out through the outflow hole 207 while the air flows into the container 400 through the air inflow groove 206, whereby the liquid of the container 400 flows out through the outflow hole 207 and outflow hole 208.

FIG. 1*l* shows the state when the opening portion N is bent in a direction. At this point, the bottom of the spout 200 being bent in a direction from the starting point of the bendable portion 205 of the spout 200.

Figure 1M:
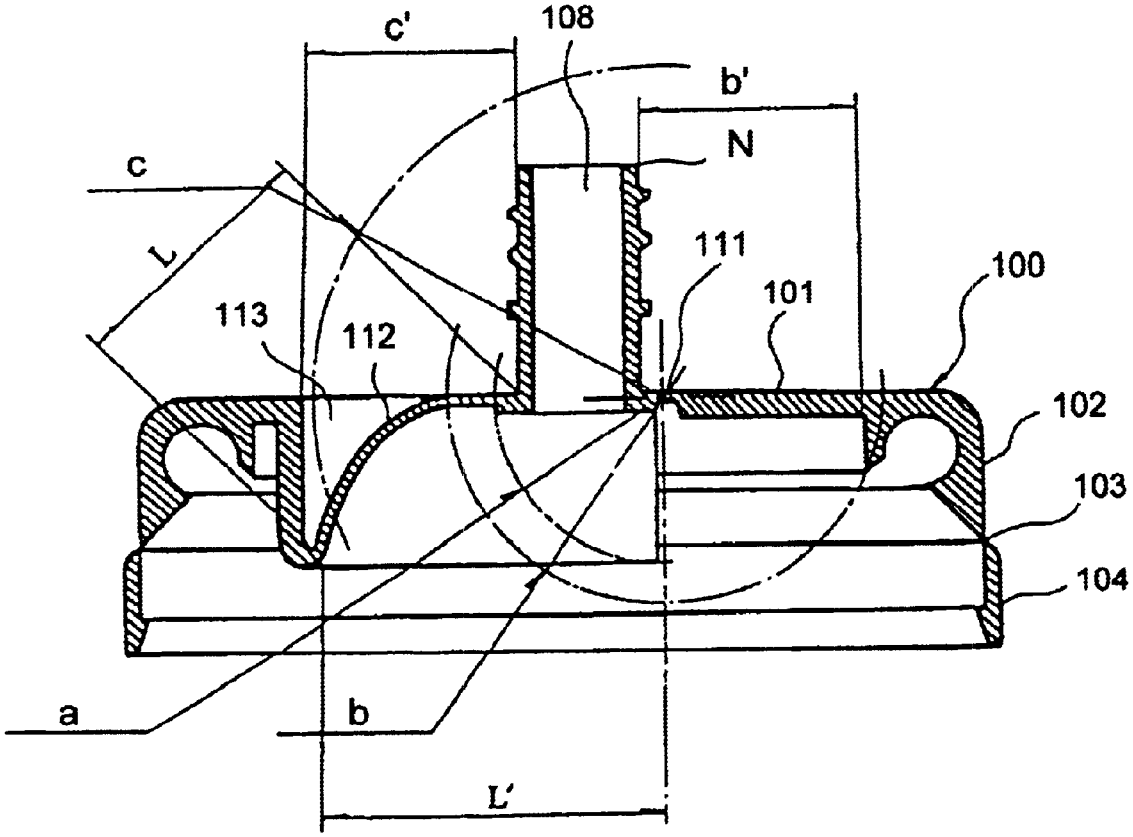
FIG. 1*m* is a sectional view illustrating an operation of a spout assembly according to the present invention.

Referring to FIG. 1*m*, the length of 'a' is proportion to the depth of the space 113, the length of 'b' is the size of the angle of moving the bendable portion 205 in a state of the spout 200 inserted into the spout inserting hole 108. As the size of 'a' increases, the length of 'b' increases.

The length 'L'' from the end of the bendable thin plate portion 112 to the connecting thin plate 111 should be longer than the length 'L' of spreading the bendable thin plate portion 112 so that the angle of bending the opening portion N increases.

Referring to FIG. 1*m*, the size 'c'' of the space 113 increases or decreases in proportion to the size 'c' of bending the opening portion N.

Figure 2:
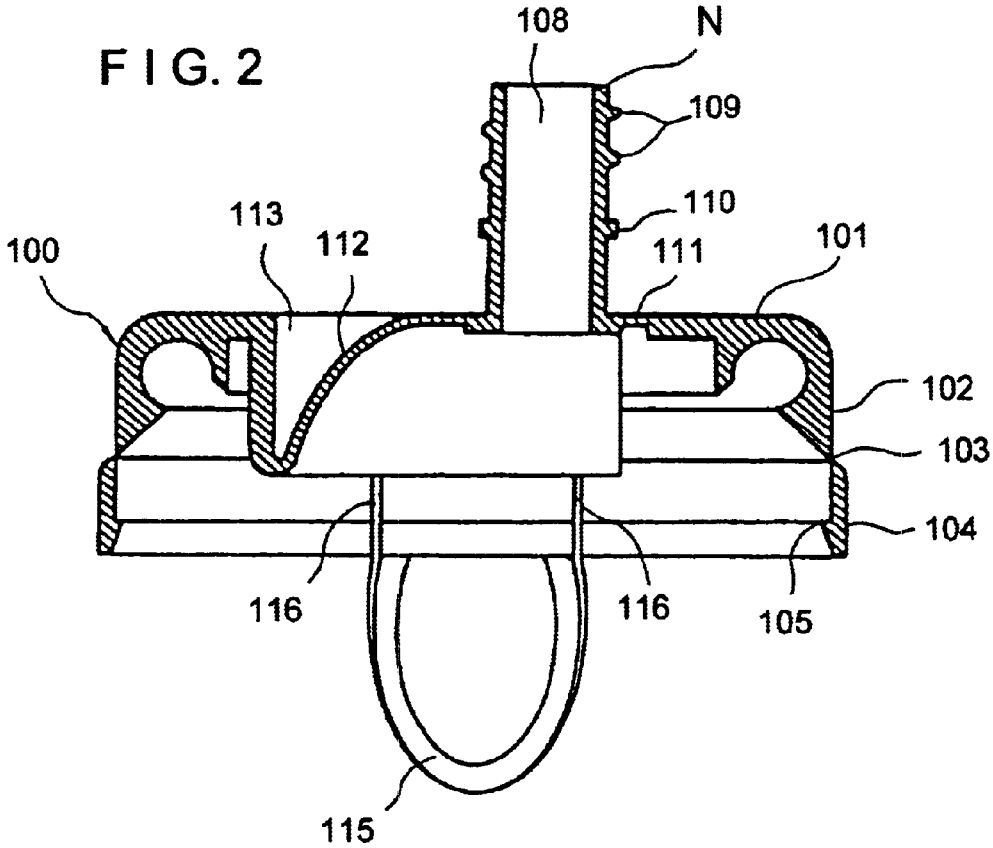
FIG. 2 is a sectional view of a main body provided with a knob at an opening identification skirt portion for removing a main body from a container by one-touching manner.

Referring to FIG. 2, the body 100 of the present invention can be separated from the neck of the container after assembled thereinto. As an embodiment, the opening identification skirt 104 is provided with a knob 115, both sides of the knob 115 are provided with a separating guide line 116, and both ends of the separating guide line 116 are connected with the separating guide line 103. When the user inserts finger into the hole of the knob 115 and pulls the knob 115, the separating guide line 116 and separating guide line 103 are separated from the body 100.

Figure 3:
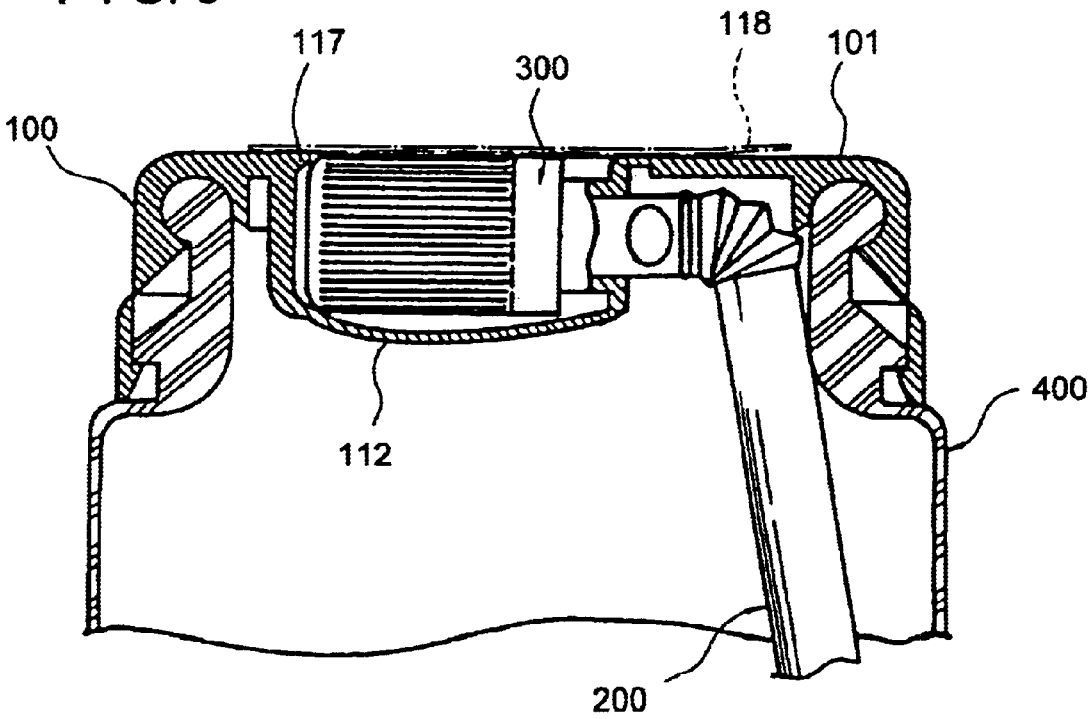
FIG. 3 is a sectional view of a main body bent in a direction.

Referring to FIG. 3, an engagement protrusion 117 is formed at the top end portion of the inner wall of the space 113 facing the opening portion N of the body. The engagement protrusion 117 has a size that an upper surface portion 301 of the cap 300 can be flexibly engaged therewith.

Furthermore, as shown in dotted line, a sticker 118 can stick to the upper surface portion 101 for covering the space 113.

Figure 4A:
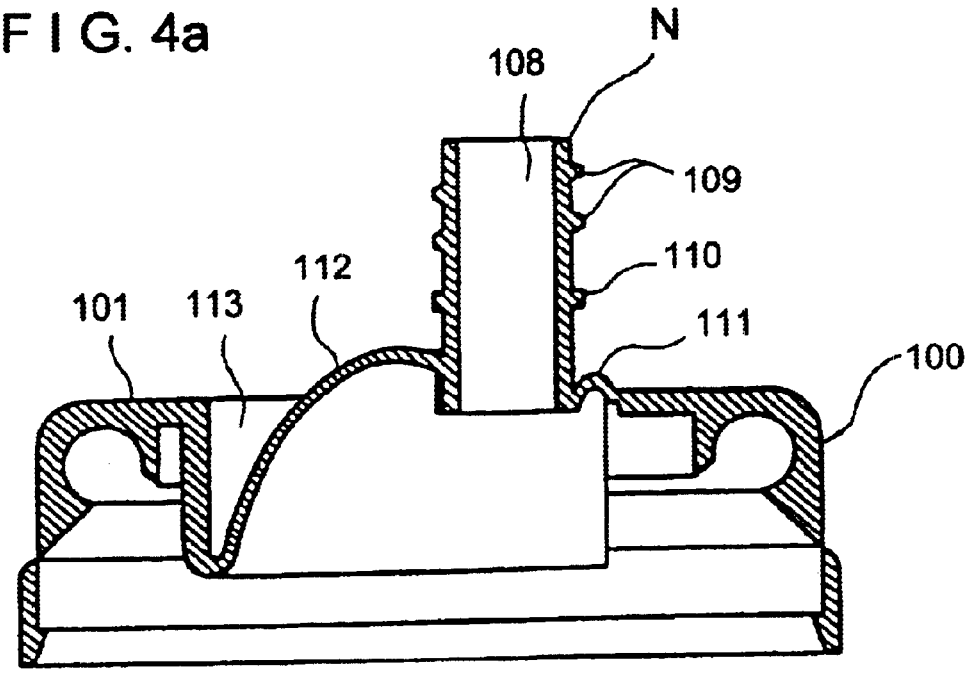
FIGS. 4*a* and 4*b* are sectional views of a main body having various shapes of bendable thin plate portions.
Figure 4B:
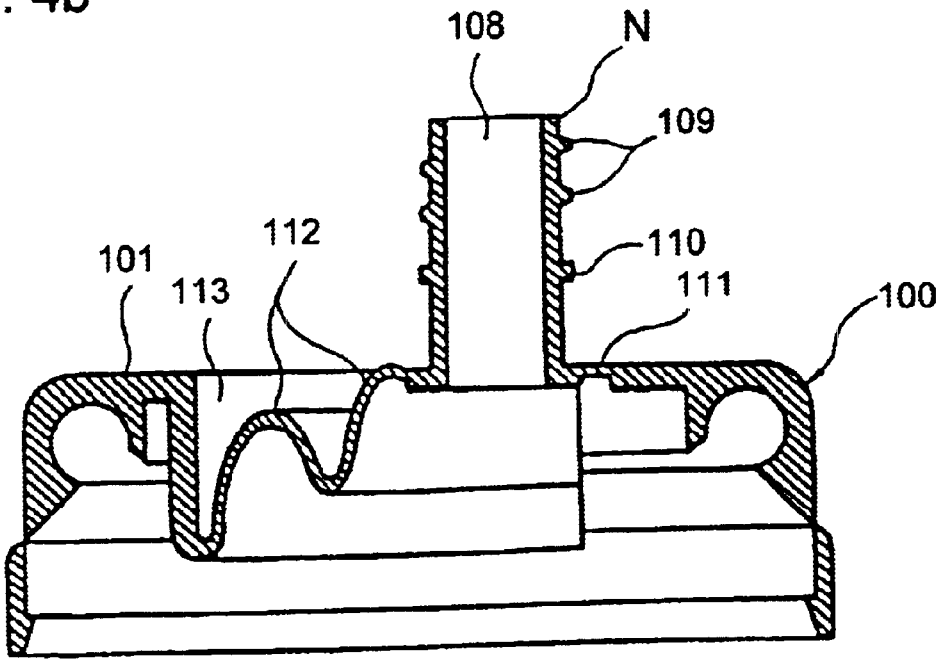

Referring to FIGS. 4*a* to 4*b*, as described in FIG. 1*m*, the size and figure of the bendable thin plate portion 112 can have various kinds for bending the opening portion N.

Figure 5:
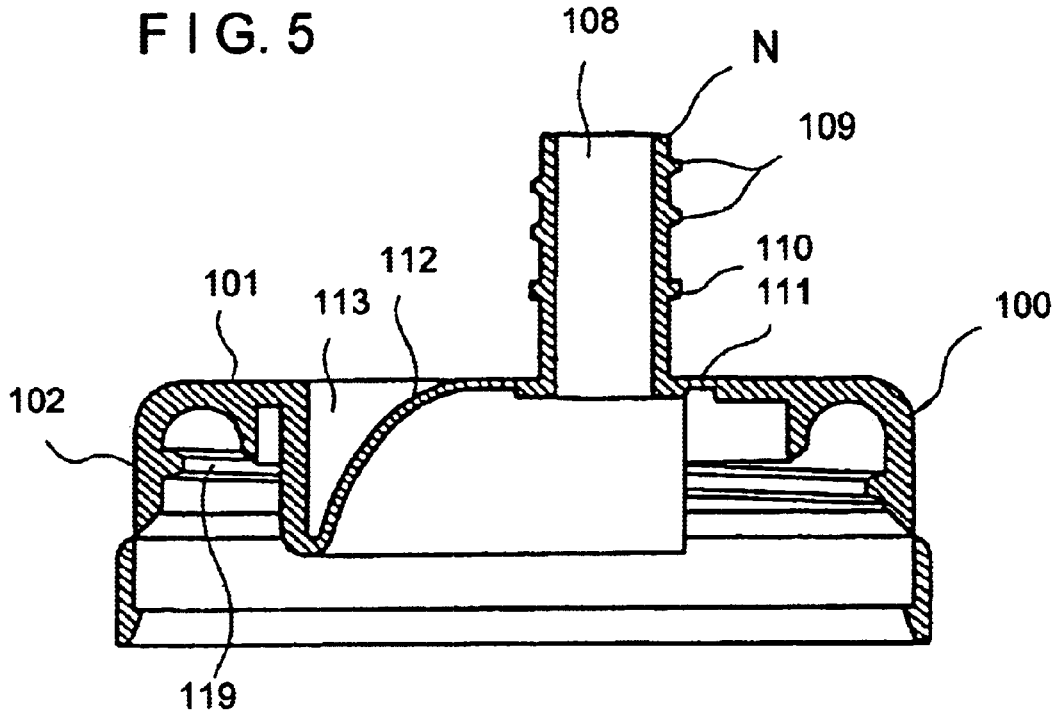
FIGS. 5 to 9 are sectional views showing that the bendable thin plate portion can apply to various kinds of containers.

FIG. 5 shows another embodiment of assembling the body 100 with the neck of the container, it is provided with a thread 119 in the inner wall of the side wall portion 102.

Figure 6:
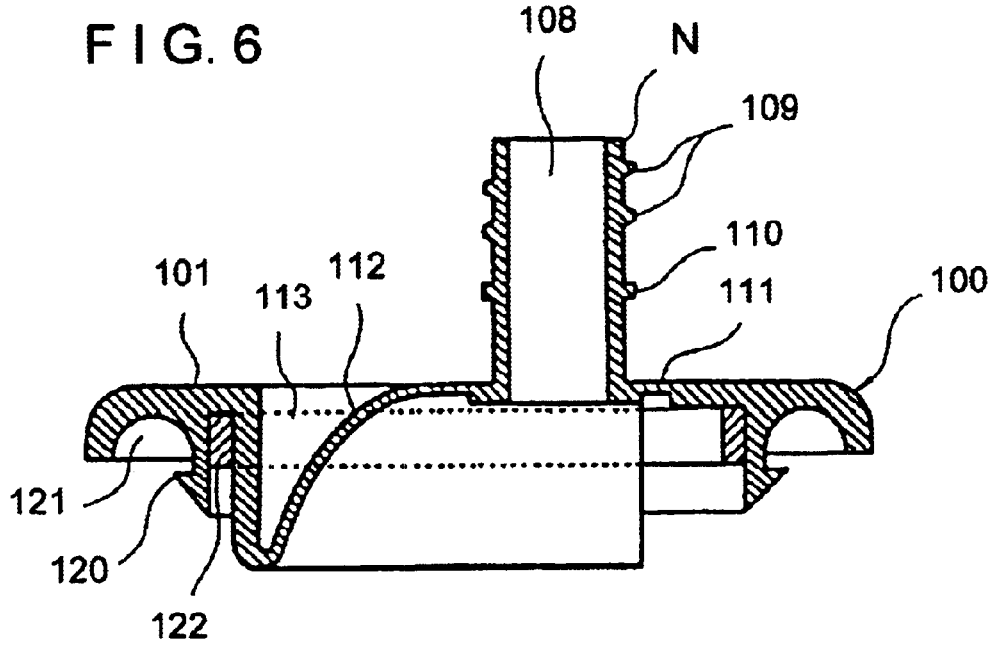

Referring to FIG. 6, the body 100 can be engaged with a punching portion of the container by pressing and is provided with an annular fixing protrusion 120 having an inserting groove 121 at the outer annular surface thereof, and a stiffening ring 122 is inserted into the inner wall of the annular fixing protrusion 120.

Figure 7:
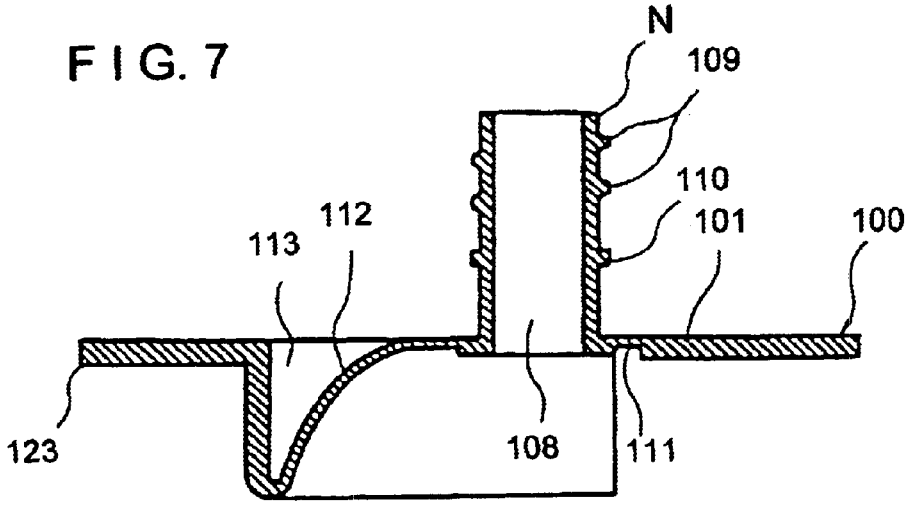

Referring to FIG. 7, the body 100, having the opening portion at a central portion, is provided with an outer annular plate 123 at the outside of the upper surface portion 101 so that the body 100 can adhere to the punching portion of the container.

Figure 8:
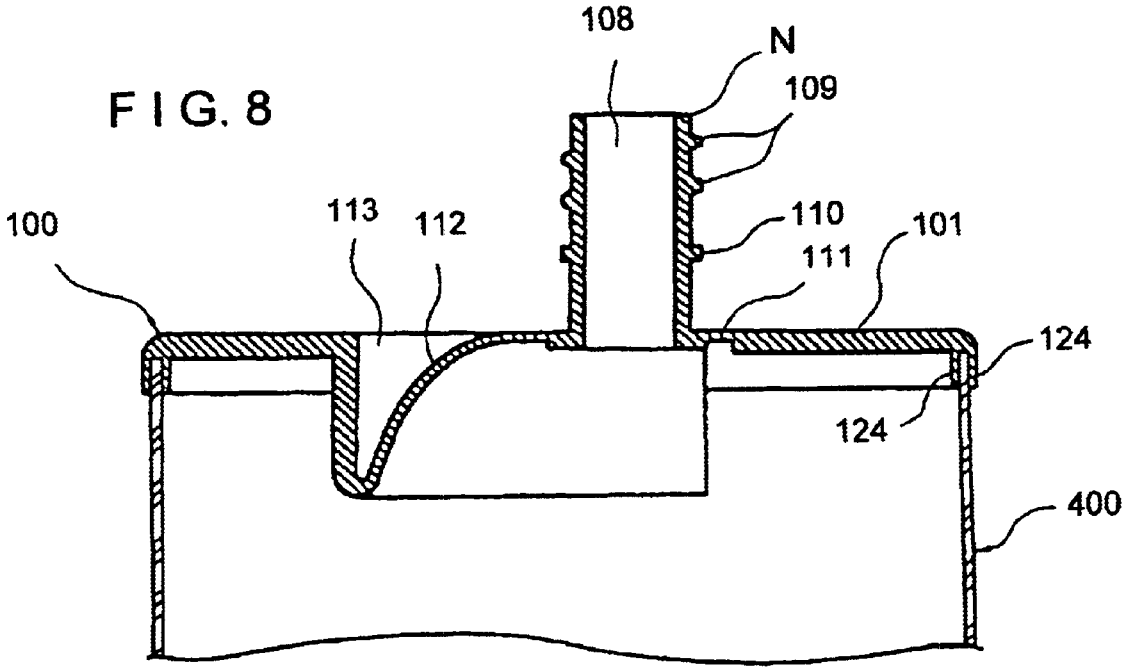

Referring to FIG. 8, an outer annular plate 124 of the body 100 is injection-molded by an inserting manner or adheres to an upper end of the container.

Figure 9:
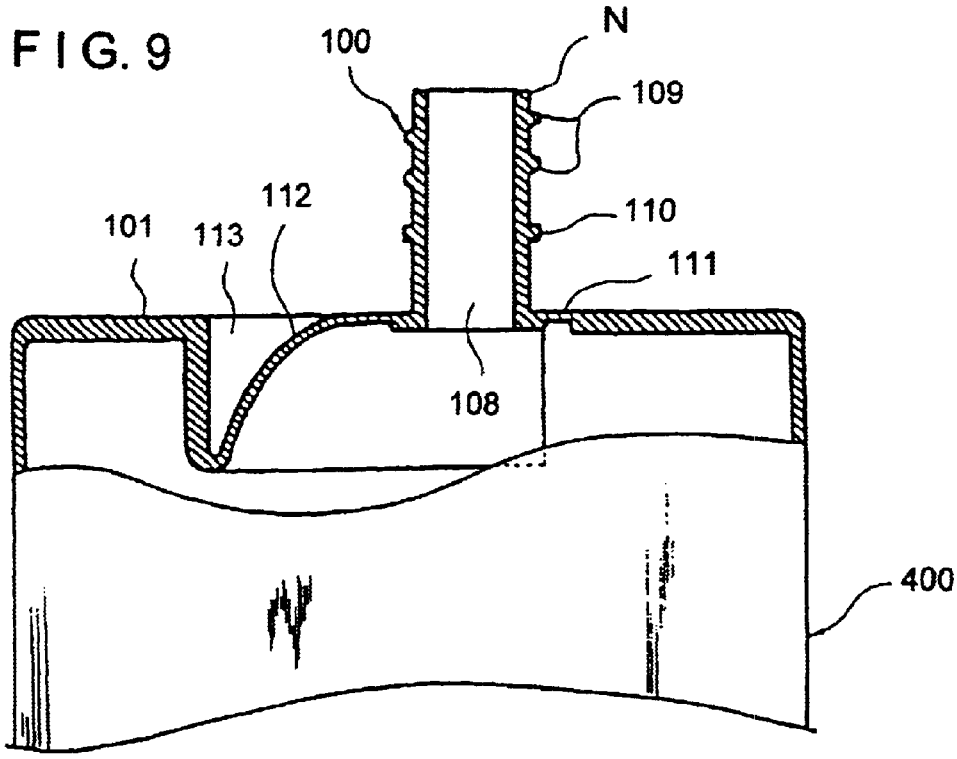
Figure 10:
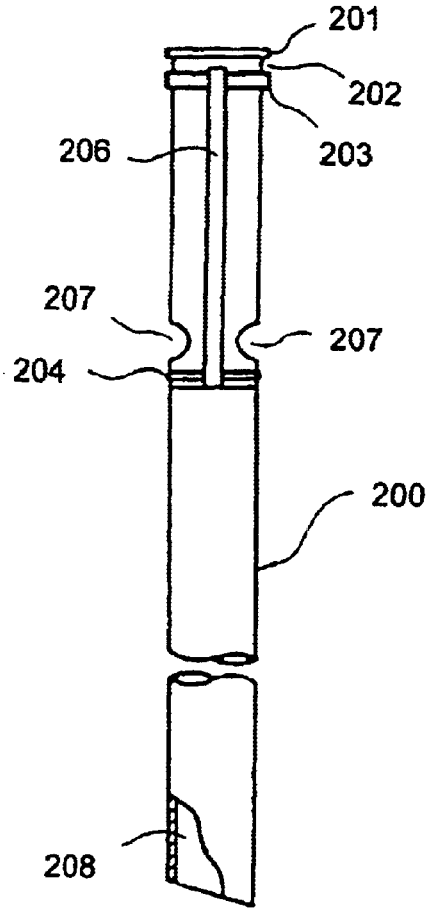
FIG. 10 is a perspective view of a spout according to another embodiment of the invention.

Referring to FIG. 9, wherein the body 100 is integrally formed with the container 400.

Figure 11:
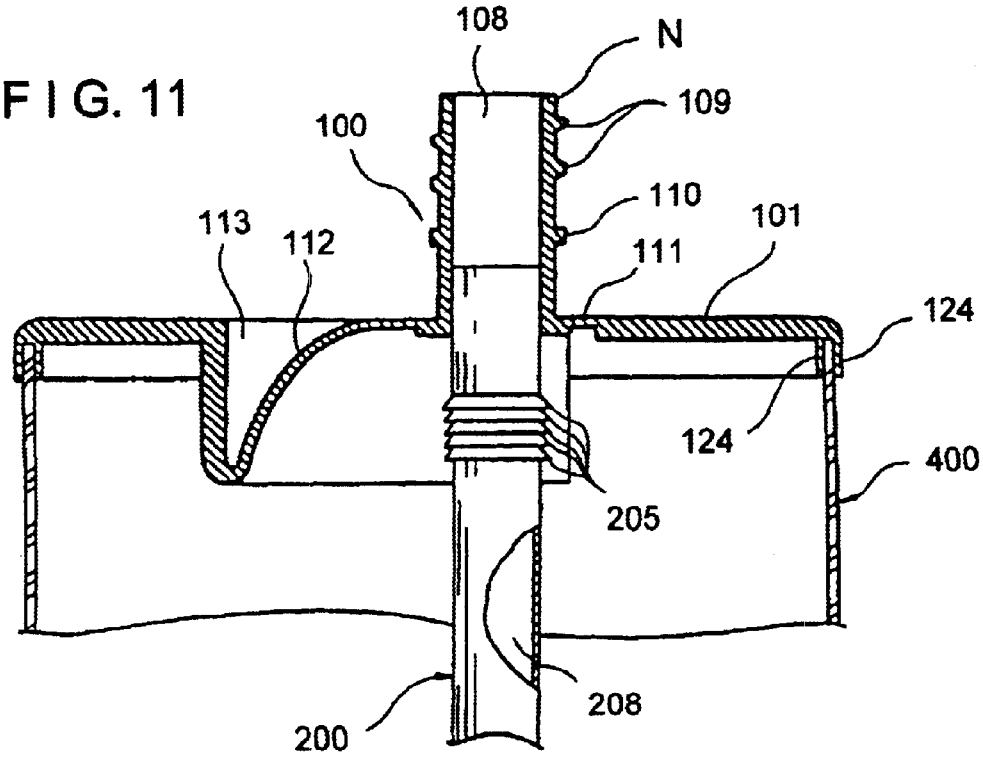
FIGS. 11 and 12 are sectional views of a main body having another embodiment of the invention.
Figure 12:
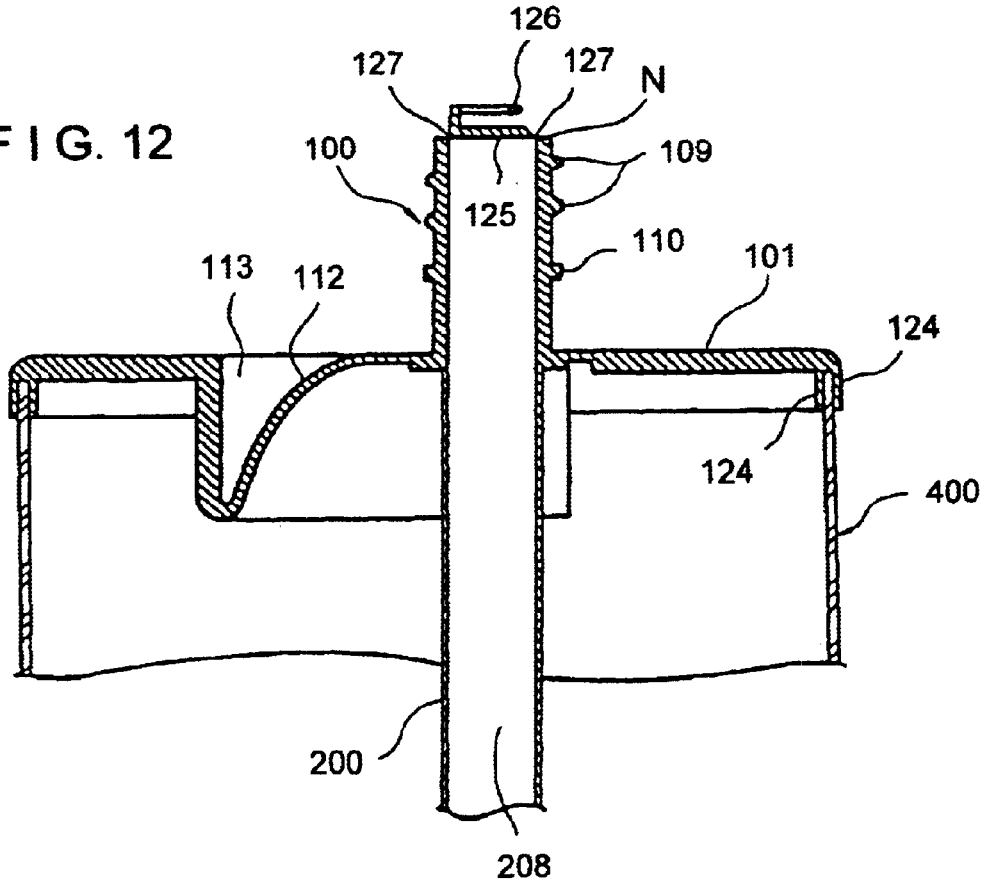

Referring to FIGS. 11 and 12, the opening portion N having the spout 200 is designed to easily shrink the container. In FIG. 11, the spout 200 for sucking the liquid is assembled around the spout inserting hole 108 of the opening portion N. In FIG. 12, the spout 200 is integrally molded with the body below the opening portion N, and a separating thin plate 125 having a pulling knob 126 is divided by a separating guide line 127 for sealing upward the opening portion N.

The spout assembly as shown in FIGS. 11 and 12 is just for sucking the liquid of the container 400.

Figure 13:
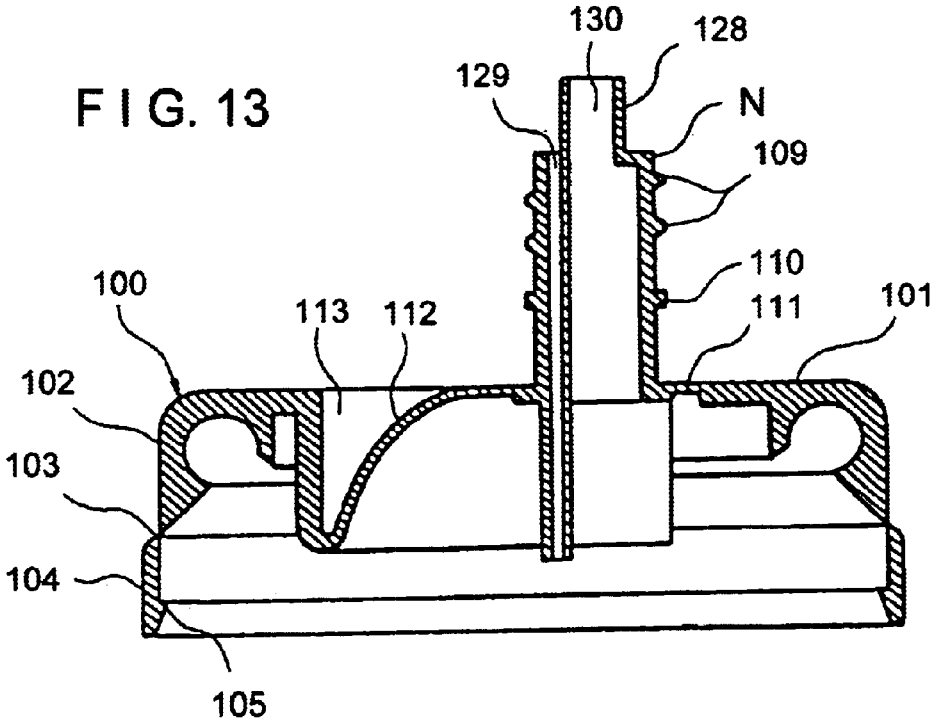
FIGS. 13 and 14 are sectional views of a main body according to another embodiments of the invention.

Referring to FIG. 13, the body is provided with a supplementary opening portion 128 upward the opening portion N, an air inflow hole 129 is longitudinally formed at the bottom of the supplementary opening portion 128 and the inner wall of the opening portion N. When the user contacts the mouse to the supplementary opening portion 128 and sucks the liquid. The air flows into the container through the air inflow hole 129 and the liquid of the container flows out. As the opening portion of the invention is provided with the air inflow hole 129, it is not need to consider materials of the container.

Figure 14:
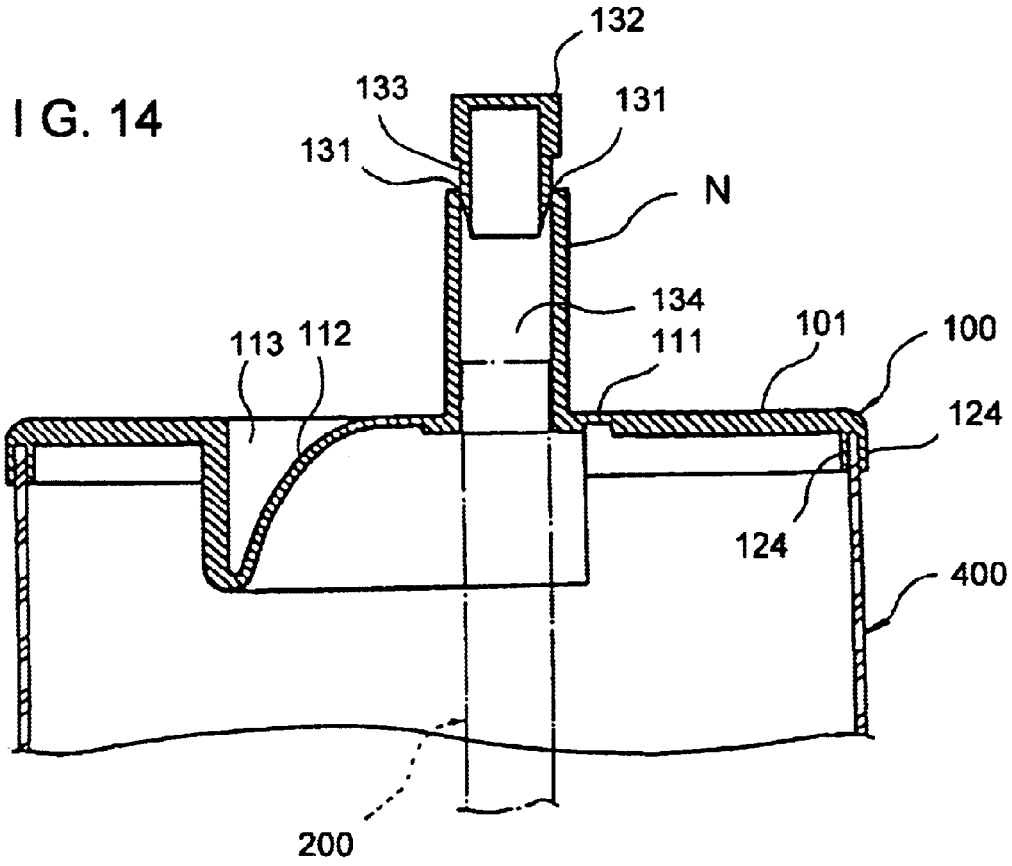

Referring to FIG. 14, the opening portion N having the spout is designed to easily shrink the container. The body 100 is provided with a cap 132 having a sealing portion 133 divided by a separating guide line 131 at the upper end of the opening portion N. When the cap 132 is rotated in an opening direction, the separating guide line is broken and the user tilts the container 400 in a direction and sucks the liquid of the container 400.

Furthermore, the body 100 of the present invention can be used without assembling the spout 200. The air inflow groove formed in the spout 200 can be applied to the inner wall of the spout inserting hole of the opening portion. But in this case, as the lateral outflow hole formed in the spout 200 must not be positioned in same of the air inflow groove formed on an inner wall of the spout inserting hole, it is less efficient than forming the air inflow groove to the spout 200 of the present invention.

The cap 300 assembled to the opening portion N can have various kinds of configuration. In another cases, the spout 200 is not moved by the cap 300 and the spout 200 can be moved by hand after opening the cap 300.

The present invention has advantage that the spout assembly is designed to enable easy and convenient drinking of liquid contained in the container through an associated spout, easily dispense the liquid into another container, and have a bendable opening portion (being coupled with a cap) which is associated with the spout and can be bent so that the containers to which the spout assemblies are applied can be stacked in a multi-layer configuration.

What is claimed is:

1. A spout assembly for a liquid container comprising:

a body 100 coupled with a neck of a container 400 including an opening portion N which is protruded from a top side of the body 100;

a spout 200 movably inserted into said opening portion N for drinking of liquid contained in the container or dispensing the liquid into another container; and a cap 300 coupled around the opening portion N to open and close the spout 200, wherein the opening portion N of the body 100 has a bendable thin plate portion and the spout 200 has a bendable portion, thereby the opening portion N of the body can be bent in a direction.

2. The spout assembly as claimed in claim 1, wherein the body is provided with an upper surface portion 101, a side wall portion 102 and an opening identification skirt 104 having an engagement jaw 105, divided by a separating guide line 103 at the bottom of the side wall portion 102, an inner surface of the side wall portion 102 is provided with an engagement jaw 107 having an inserting groove 106, the upper surface portion 101 is provided with the opening portion N having a spout inserting hole 108 upwardly protruded therefrom, an outer annular portion of the opening portion N is provided with a thread 109 and a bottom protruding annular portion 110, a parabola shaped bendable thin plate portion 112 is provided at the opposite portion of a connecting thin plate 111 in the bottom of the opening portion N and on the upper portion 101, and a space 113 having a guiding portion 114 is provided at the outside of the bendable thin plate 112.

3. The spout assembly as claimed in claim 2, wherein the opening identification skirt 104 is provided with a knob 115, both sides of the knob 115 are provided with a lateral separating guide line 116, and both ends of the lateral separating guide line 116 are connected with the separating guide line 103.

4. The spout assembly as claimed in claim 2, wherein the inner surface of the side wall portion 102 is provided with at least one thread 119.

5. The spout assembly as claimed in claim 2, wherein the body 100 can be engaged with a punching portion of the container by pressing and is provided with an annular fixing protrusion 120 having an inserting groove 121 at the outer annular surface thereof, and a stiffening ring 122 is inserted into the inner wall of the annular fixing protrusion 120.

6. The spout assembly as claimed in claim 2, wherein the body 100, having the opening portion at a central portion, is provided with an outer annular plate 123 at the outside of the upper surface portion 101 so that the body 100 can adhere to the punching portion of the container.

7. The spout assembly as claimed in claim 2, wherein an outer annular plate 124 of the body 100 is injection-molded by an inserting manner or adheres to an upper end of the container.

8. The spout assembly as claimed in claim 2, wherein the body 100 is integrally formed with the container 400.

9. The spout assembly as claimed in claim 2, wherein the length 'L' of spreading bendable thin plate portion 112 formed below the opening portion N equals or is longer than the length 'L'' from the end of the bendable thin plate portion 112 to the connecting thin plate 111.

10. The spout assembly as claimed in claim 9, wherein the bendable thin plate portion 112 is shaped like an parabola or at least one peak.

11. The spout assembly as claimed in claim 2, wherein an engagement protrusion 117 is formed at the top end portion of the inner wall of the space 113 facing the opening portion N of the body.

12. The spout assembly as claimed in claim 11, wherein the engagement protrusion 117 has a size that an upper surface portion 301 of the cap 300 can be flexibly engaged therewith.

13. The spout assembly as claimed in claim 1, wherein the spout 200, at an upper end thereof is provided with an annular protrusion 201, an annular groove 202 and an annular band 203, at a bottom end thereof is provided with an annular band 204 and a bendable thin plate 205, is provided with an air inflow groove 206 longitudinally between annular bands 203 and 204, is provided with at least one side outflow hole 207 at each side of the air inflow groove 206, and the side outflow hole 207 is communicated with a liquid passage 208.

14. The spout assembly as claimed in claim 13, wherein the spout 200 is formed with flexible materials so that the spout 200 is bendable.

15. The spout assembly as claimed in claim 1, wherein the cap 300 comprises an upper surface portion 301 and a side wall portion 302, and is provided with an opening identification skirt 304 having an engagement jaw 305 divided by a separating guide line 303 at the bottom of the side wall portion 302, the inner wall of the side wall portion is optionally provided with an engaging protrusion 306 having an annular engagement groove 307, the bottom inner wall of the engagement protrusion 306 is formed with a sealing wall 308 for maintaining the searing contacting the outer circumference surface of the upper end of the opening portion N of the body 100, and downwardly therewith, a thread 309 for engaging the thread 109 of the opening portion N is provided.

16. The spout assembly as claimed in claim 15, wherein the engaging protrusion 306 of the cap 300 is engaged with and fixed to the annular protrusion 201 of the spout 200.

17. The spout assembly as claimed in claim 16, wherein processes of opening the cap 300 includes that the engaging protrusion 306 engages with the annular protrusion 201 and pulls the spout 200, before the bottom end thread 309 of the cap 300 is separated from the upper end of the thread 109 of the opening portion N, the annular band 204 of the spout 200 is engaged with the bottom end of the spout inserting hole of the opening portion N and then the annular protrusion 201 is separated from the annular engaging protrusion 306.

18. The spout assembly as claimed in claim 15, wherein the spout 200 can be pushed and pulled by hand when the cap 300 is separated from the opening portion N.

19. A spout assembly for a liquid container comprising:

a body 100 coupled with a neck of a container 400 including an opening portion N which protrudes from a top side of the body 100; and a cap 300 for closing the opening portion N;

a sticker 118 which sticks to the upper surface portion 101 of the body 100 after the opening portion N is bent in a direction;

wherein the opening portion N of the body has a bendable thin plate portion so that the opening portion N of the body can be bent in a direction.

20. The spout assembly as claimed in claim 19, further comprising a spout 200 having a bendable portion 205 which is inserted into a spout inserting hole 108 of the opening portion N of the body.

21. The spout assembly as claimed in claim 20, wherein the opening portion N having the spout is designed for a shrinkable container.

22. The spout assembly as claimed in claim 19, further comprising a spout 200 is integrally formed with the body below the opening portion N, a separating thin plate 125 having a pulling knob 126 is divided by a separating guide line 127 for sealing upward the opening portion N.

23. The spout assembly as claimed in claim 19, wherein the body is provided with a supplementary opening portion 128 upward the opening portion N, an air inflow hole 129 is longitudinally formed at the bottom of the supplementary opening portion 128 and the inner wall of the opening portion N.

24. The spout assembly as claimed in claim 19, wherein cap 132 comprises a sealing portion 133 divided by a separating guide line 131 at the upper end of the opening portion N.

25. The spout assembly as claimed in claim 19, wherein spout 200 is downwardly extended through the opening portion N.

* * * * *